US008807814B1

(12) United States Patent
Glenn

(10) Patent No.: US 8,807,814 B1
(45) Date of Patent: Aug. 19, 2014

(54) COMBINATION FAN AND LIGHT ATTACHABLE TO A HAT

(76) Inventor: Joseph Gregory Glenn, Niceville, FL (US)

( * ) Notice: Subject to any disclaimer, the term of this patent is extended or adjusted under 35 U.S.C. 154(b) by 139 days.

(21) Appl. No.: 13/360,434

(22) Filed: Jan. 27, 2012

(51) Int. Cl.
*F21V 5/00* (2006.01)

(52) U.S. Cl.
USPC ..... 362/580; 362/103; 362/106; 362/577; 2/171.3

(58) Field of Classification Search
USPC ..... 362/103, 105, 106, 577, 580; 2/171, 2/171.3, 209.13
See application file for complete search history.

(56) References Cited

U.S. PATENT DOCUMENTS

| | | | |
|---|---|---|---|
| 539,192 | A | 5/1895 | Rodriguez et al. |
| 2,524,881 | A | 10/1950 | Chambers |
| D188,129 | S | 6/1960 | Wansky et al. |
| 2,989,049 | A | 6/1961 | Crouzet |
| 3,032,647 | A | 5/1962 | Wansky et al. |
| 3,168,748 | A | 2/1965 | Limberg |
| 3,881,198 | A | 5/1975 | Waters |
| 4,406,040 | A | 9/1983 | Cannone |
| 4,546,496 | A | 10/1985 | Lewis |
| 4,680,815 | A | 7/1987 | Hirsch et al. |
| 4,991,068 | A | 2/1991 | Mickey |
| 5,412,545 | A | 5/1995 | Rising |
| 5,425,620 | A | 6/1995 | Stroud |
| 5,463,538 | A | 10/1995 | Womack |
| 5,541,816 | A | 7/1996 | Miserendino |
| 5,567,039 | A | 10/1996 | Sims |
| 5,741,060 | A | 4/1998 | Johnson |
| D396,340 | S | 7/1998 | She |
| D411,756 | S | 7/1999 | Land |
| 6,032,291 | A | 3/2000 | Asenguah et al. |
| 6,250,769 | B1 | 6/2001 | Lirk |
| 6,895,602 | B2 | 5/2005 | Schlapkohl |
| 6,908,208 | B1 | 6/2005 | Hyde et al. |
| 6,969,178 | B2 | 11/2005 | Zuloff |
| 7,163,309 | B2 | 1/2007 | Sohn |
| 7,331,064 | B1 | 2/2008 | Quintal |
| 7,708,422 | B2 | 5/2010 | Sohn |
| 7,753,547 | B2 | 7/2010 | Waters |
| 2002/0186557 | A1 | 12/2002 | Lary et al. |
| 2004/0064871 | A1 | 4/2004 | Schlapkohl |
| 2005/0078473 | A1 | 4/2005 | Zuloff |
| 2006/0133069 | A1 | 6/2006 | Clupper et al. |
| 2008/0130272 | A1 | 6/2008 | Waters |
| 2008/0198579 | A1 | 8/2008 | Crye et al. |
| 2008/0266839 | A1 | 10/2008 | Claypool et al. |
| 2009/0031475 | A1 | 2/2009 | Ochoa et al. |
| 2009/0126076 | A1 | 5/2009 | Ochoa |
| 2009/0225534 | A1 | 9/2009 | Thomas et al. |
| 2010/0000007 | A1 | 1/2010 | Wood |
| 2010/0313335 | A1 | 12/2010 | Waters |
| 2011/0013383 | A1 | 1/2011 | Medinis |
| 2011/0050123 | A1 | 3/2011 | Duerr et al. |
| 2011/0122601 | A1 | 5/2011 | Waters |

*Primary Examiner* — Meghan Dunwiddie
(74) *Attorney, Agent, or Firm* — Peter Loffler

(57) ABSTRACT

A light and fan assembly has a generally tubular housing that has a turbine fan located on one end the fan discharging a stream of air therefrom, and a light is located on the opposing end, the light discharging a light beam therefrom in opposite direction to the air stream. A clip clips the housing to an appropriate surface such as a hat brim. The fan can draw air from one of two intakes with one of the intakes allowing air to pass over a heat sink of the light to help cool the light assembly and warm the air stream or resistive heating elements can be provided in order to heat the air stream. A magnifying lens is attached, fixedly or pivotally and possibly rotatably, to the housing.

30 Claims, 11 Drawing Sheets

COMBINATION FAN AND LIGHT ATTACHABLE TO A HAT

BACKGROUND OF THE INVENTION

1. Field of the Invention

The present invention relates to a fan and a light held within a single housing yet operable independently of one another, the housing attachable to the brim of a hat or similar structure.

2. Background of the Prior Art

Keeping cool in the summer heat can often be a challenge. Indoor and automotive air conditioning is standard operating fare in most situations allowing a person who is at home or the office or commuting to be able to stay relatively cool. However, often the great indoors are not to be had and the hot air can suck the energy out of a person. For example, sitting in an outdoor baseball stadium watching nine innings, working in the yard, or walking around an amusement park with the kids, can all leave a person hot and sweaty.

One simple method for keeping cool has a person fanning him or herself. The most basic fan is a handheld fan with a short handle and a relatively flat surface, often made of paper or similar material, with the device being manually waved back and forth in order to create a breeze, often targeted at the person's face. While effective, this method of fanning is labor intensive and can only be comfortably performed for short durations. Automatic fans use a small battery powered motor that spins a series of fan blades that create a breeze. While also effective and less labor intensive than a manual fan, these types of devices still require a person to hold the device during device operation, which holding becomes strenuous after a certain amount of holding. Accordingly, these battery powered fans also tend to be used for relatively short periods of time.

In order to provide automatic fanning of a person's head, and to overcome the need to carry a motor and battery pack by hand, fan hats have been proposed. Such devices attach a fan—some even with a mini air conditioner thereat—to a hat with the fan providing a stream of air onto the person's head, often the face, in order to help fan the person and make the person more comfortable. Such devices use the person's head as support instead of requiring a hand carry of the fan. If the device is relatively small, a head supported device can be carried indefinitely without introducing undue strain onto the person's head, neck or back.

Although these devices tend to be used for longer periods of time than a manual fan or a handheld fan, such devices are not without drawbacks. Some of the prior art devices are relatively large and require a substantial battery pack so that such devices can still become uncomfortable to a person after extended use. Some devices require an enclosed volume of air to be provided by the hat for proper device usage. Such hats, typically top hats, tend not to find favor with many wearers both from a fashion and a comfort point of view. Still other devices require a modification to the hat, especially if the fan directs air at the person's face. As such, such devices tend to be limited to a particular hat or require the user to make undesirable modifications to his or her hats, modifications, which many users are either unable or unwilling to make.

A separate problem encountered by people is the need to provide artificial light in a variety of situations. Walking in a dark place, such as an unlit park or corridor, reading a menu in a dimly lit restaurant, or searching for an item in an awkward area, such as underneath a car seat, are all examples where artificial light is a welcome assistant.

A flashlight is a very common tool used to provide artificial light. Flashlight can be aimed as desired, are relatively light-weight, and with the new technologies in both electrical storage and bulbs, can last a relatively long time without the need to change or recharge the flashlight's batteries. While effective, many light lacking situations are not well suited for flashlight use. A person walking through a dark park or on a dark beach, may have his or her hands full with the day's outing paraphernalia and carrying a flashlight may provide difficult. Often a person will place the flashlight into the arm pit area which is uncomfortable and which makes and proper aiming of the flashlight difficult. Many people would not feel comfortable taking out a flashlight in a restaurant.

To address this problem, lights attachable to a hat have been proposed. These devices allow placement of a flashlight or similar light producing system (some use candles) and allow the person to carry the light and aim the light by his or her head freeing up the arms for other uses. Some of the prior art devices are relatively complex in design and tend to be heavy so that extended use of such devices can become uncomfortable.

What is needed is a device that solves both of the above stated needs in the art by providing a device that cools a person's face while allowing the person to be able to cast a light beam in a desired direction. Such a device must be head operated in that the device is carried by the person's head as opposed to his or her hands and is directionally controlled by the head so that the person can use the hands for other tasks. Such a device must be relatively light weight so that it can be carried by the person's head for extended periods of time without becoming gravitationally uncomfortable. Such a device must not require that the person wear a top hat or a specialized hat for use or require the person to make significant modifications to existing hats. Ideally, such a device should be of relatively simple design and construction so as to be relatively easy to produce in order to keep the end costs of such a device at a reasonable level so as to make the device readily affordable to a large segment of potential consumers for this type of device.

SUMMARY OF THE INVENTION

The combination fan and light attachable to a hat of the present invention addresses the aforementioned needs in the art by providing a single device that blows cooling (or possibly heating) air across a person's face and provides a light beam that is amiable by the person, without the need to use the hands for carrying or directional control of the device. The combination fan and light attachable to a hat is relatively light so that extended carrying of the device, whether operational or not, does not pose an undue strain onto the person's head, neck, shoulders, or back. The combination fan and light attachable to a hat is simple in design and construction, and does not require the use of a select style of hat and does not require extensive modifications to an existing hat. The combination fan and light attachable to a hat is produced using standard manufacturing techniques. This makes the potential price point of the device relatively low so as to allow the device to be readily affordable to a large segment of potential consumers for this type of product.

The combination fan and light attachable to a hat is comprised of a generally cylindrical tubular housing member that has a first end and a second end and also has a first intake opening located therebetween. A turbine fan is located on the first end of the housing member such that the fan is capable of drawing an air stream through the first intake opening and discharging the air stream outwardly from the first end of the housing in a first direction. A light assembly is located on the opposing second end of the housing member such that the light assembly discharges a beam of light outwardly from the second end of the housing in a second direction that is generally opposite in direction to the first direction. A clip, either a one way clip or a two way clip, is attached to the housing. The clip is capable of rotating radially about the housing. The housing may optionally have a second intake opening such that the fan can draw the air stream through either the first intake opening or the second intake opening or both such that if the air stream is drawn through the second intake opening the air stream passes over a heat sink of the light assembly thereby helping cool the heat sink and warm the air stream. The heat sink is located within the housing. In such a configuration, a slide assembly is attached to the housing for selectively closing either the first intake opening or the second intake opening but not both simultaneously. Optionally, one or more resistive heating elements, powered by the batteries of the device, can be located proximate the discharge area of the fan at the first end of the housing member such that the resistive elements heat up when a current passes therethrough and the air stream that passes over the heated elements has its temperature raised. A magnifying lens may be attached to the housing such that the magnifying lens is either pivotally attached to the housing or fixedly attached to the housing and such that the magnifying lens is capable of rotating radially about the housing. A filter is removably attachable to the first end of the housing such that the light beam issued by the light assembly passes through the filter.

BRIEF DESCRIPTION OF THE DRAWINGS

Similar reference numerals refer to similar parts throughout the several views of the drawings.

DESCRIPTION OF THE PREFERRED EMBODIMENT

Figure 1:
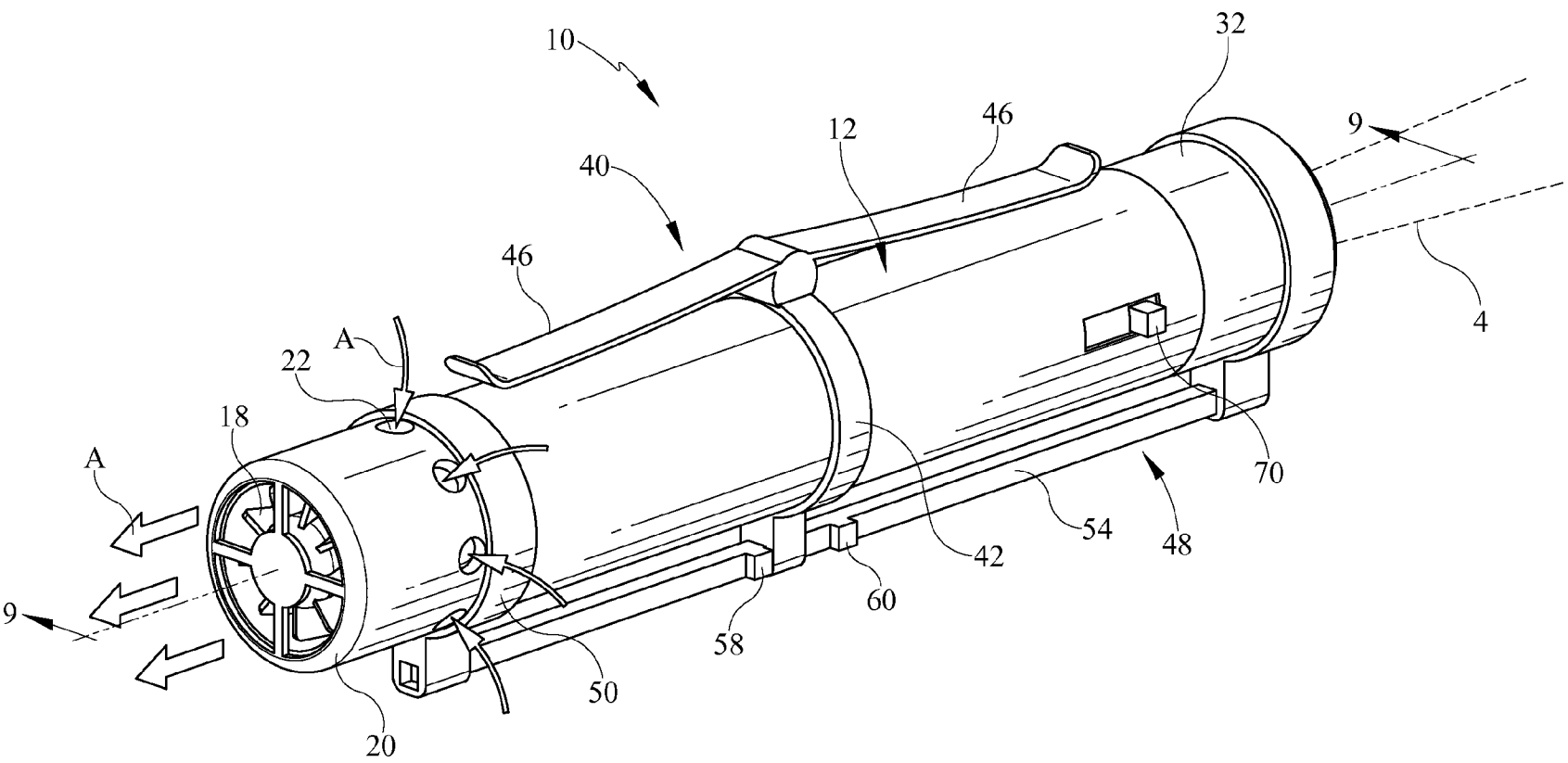
FIG. 1 is a fan side perspective view of the combination fan and light attachable to a hat of the present invention.
Figure 2:
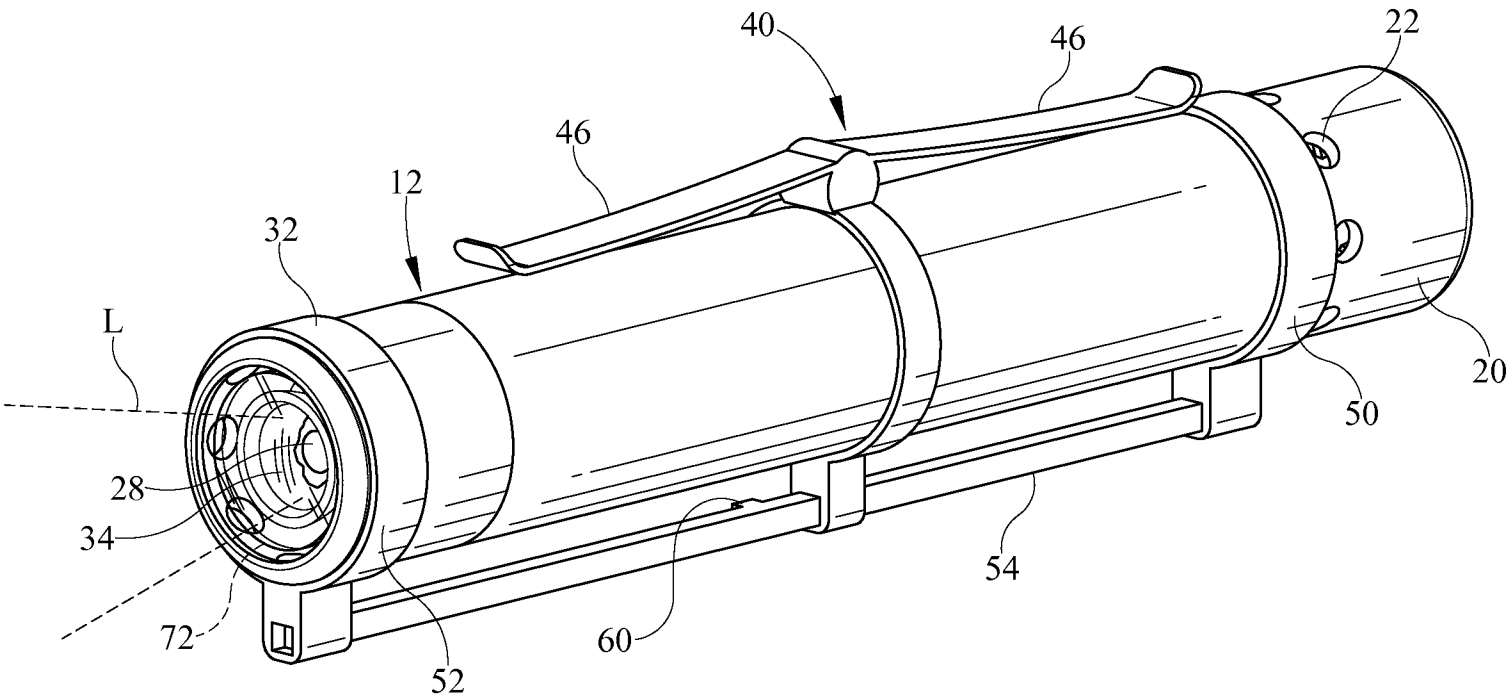
FIG. 2 is a light side perspective view of the combination fan and light attachable to a hat.

Referring now to the drawings, it is seen that the combination fan and light attachable to a hat of the present invention, generally denoted by reference numeral 10, is comprised of a housing 12 that is an elongate tubular member having a hollow interior and having a first end 14 and an opposing end 16. Attached to the first end 14 of the housing 12 is a fan assembly that comprises a turbine fan 18 and a fan cap 20 that has a series of first intake openings 22 and outlet openings 24, the turbine fan 18 being held within the fan cap 20 and the fan cap 20 attached to the first end 14 of the housing in any appropriate fashion such as by threadable attachment, frictional attachment or an appropriate fixed attachment such as via an appropriate adhesive, ultrasonic welding, etc.

Attached to the second end 16 of the housing 12 is a light assembly which includes a bulb mount 26 holding a light bulb 28 (LED, incandescent, etc.) therein, a heat sink 30 all held within a light cap 32 that is attached to the second end 16 of the housing 12. The light cap 32 has a protective cover 34 thereon for protecting the bulb 28 and may optionally have a series of second intake openings 36 similar to the intake opening 22 on the fan cap 20. The light cap 32 is attached to the second end 16 of the housing 12 in similar fashion to the manner in which the fan cap 20 is attached to the first end 14 of the housing 12 in that the light cap 32 can be threadably or frictionally attached to the second end 16 of the housing 12 or may be fixedly attached thereto in appropriate fashion. Advantageously, not more than one of the fan cap 20 or the light cap 32 is fixedly attached to its respective end of the housing 12 in order to allow at least one of the caps 20 or 32, or both, to be removable from the housing 12 in order to provide service access into the interior of the housing 12. The protective cover 34 of the light cap 32 can be a simple flat protective cover as is typically found on flashlights, or can be a focusing lens so changing the width of the light beam L issued by the light bulb 28 is achieved via rotation or counterrotation of the light cap 32

Batteries 38 are held within the main portion of the interior of the housing 12, the batteries 38 providing electrical power for both the turbine fan 18 and the light bulb 28, the precise nature of the wiring architecture being well known in the art and not illustrated in detail.

Either a one way, or the illustrated two way clip assembly 40 is attached to the housing 12 in appropriate fashion. As seen, the clip assembly 40 has a ring 42 that rotatably encircles the housing 12 and is seated within a groove 44 located medially on the exterior of the housing 12 and also has clips 46 that extend in either direction from the ring 42 (or in only one direction in the case of a one way clip, that direction being toward the first end 14 of the housing 12. The clips 46 can be attached directly to the housing 12 without the use of the ring 42.

If a dual intake configuration is used, the a slide assembly 48 is provided and has a first covering ring 50 and a spaced apart second covering ring 52 that is connected to the first covering ring 50 by a slide 54, the slide 54 slidably passing through an opening 56 located on the clip assembly 40 (or other opening if the clip assembly 40 does not use a ring 42). A first stop 58 and a spaced apart second stops 60 are each located on the slide 54 and limit the amount of travel of the slide 54 within the opening 56 on the clip assembly 40.

As the clip assembly 40 and the slide assembly 48 are two distinct units, one of the components is manufactured as two pieces in order to allow the slide 54 to be positioned within the opening 56 with the stops 58 and 60 being located on either side of the opening 56. For example, the slide 54 can be as two pieces jointed together between the stops 58 and 60 so that the slide 54 is positioned within the opening 56 and thereafter the two pieces fixedly attached to one another, or one or both of the stops 58 and/or 60 can be added to the slide 54 after the slide 54 is positioned within the opening 56, or the opening area can be formed in two pieces, etc.

When the slide 56 is slid so that the first stop 58 engages the side of opening area of the clip assembly 40, then the second covering ring 52 covers the second intake openings 36 of the light cap 32 preventing air A from entering these openings 36 while the first covering ring 50 is positioned such that the first covering ring 50 does not cover the first intake openings 22 of the fan cap 20. In this manner, when the turbine fan 18 is operational, the fan 18 draws air A through the first intake openings 22 and blows the drawn air A out through the outlet 24 of the fan cap 20, as best seen in FIG. 1.

Figure 6:
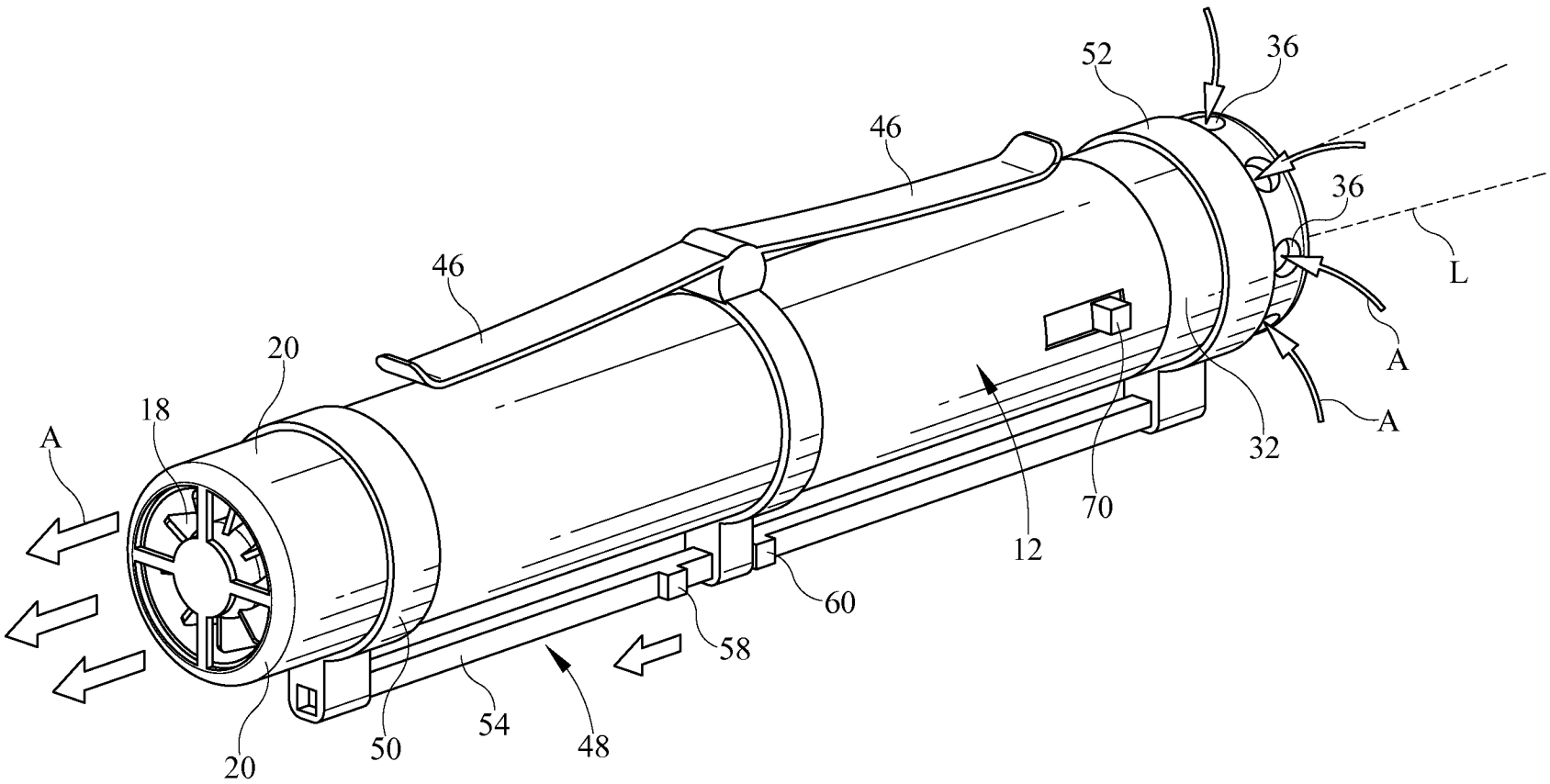
FIG. 6 is a fan side perspective view of the combination fan and light attachable to a hat with the air being drawn by the fan into the device housing proximate the light
Figure 9:
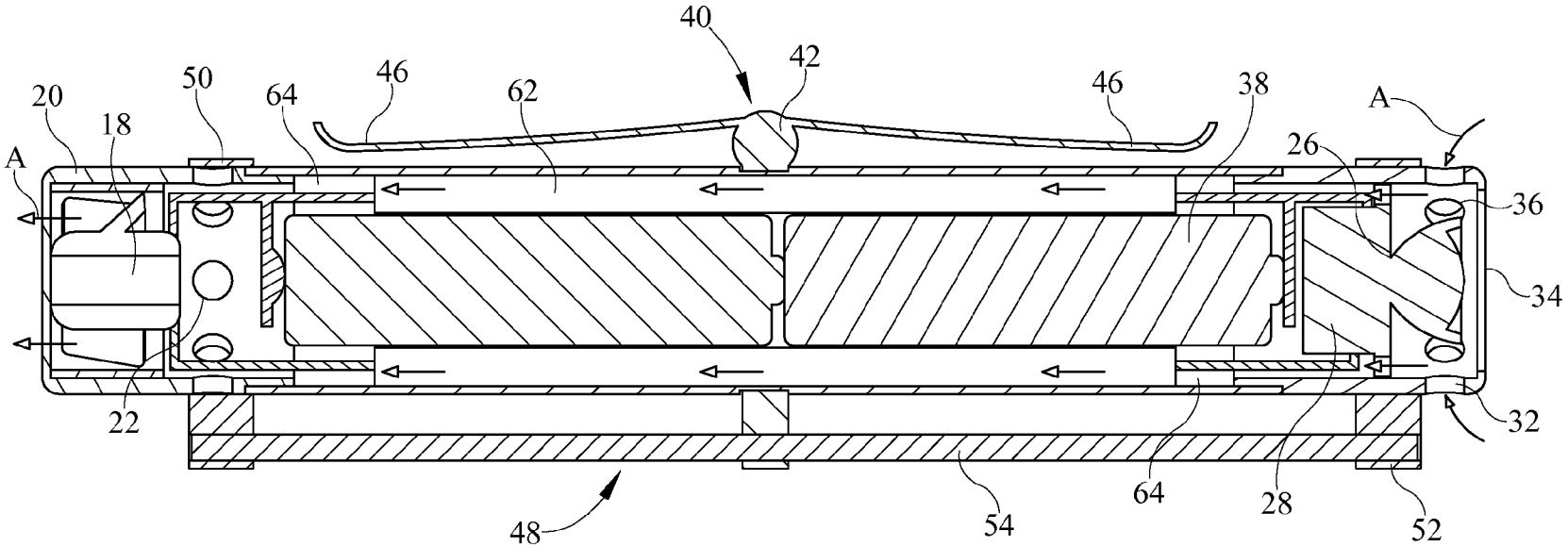
FIG. 9 is a sectioned view of the combination fan and light attachable to a hat taken along line 9-9 in FIG. 1.
Figure 10:
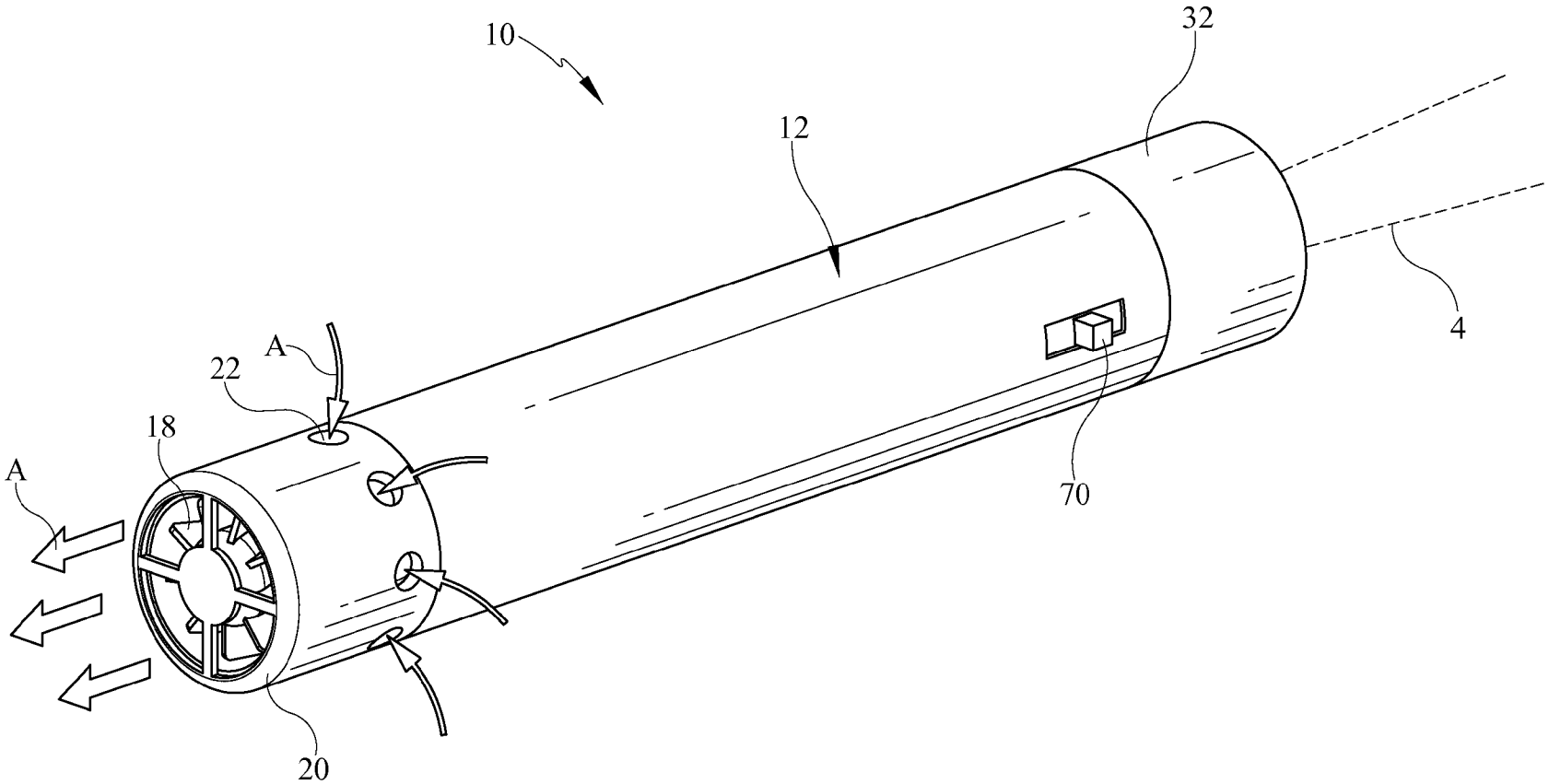
FIG. 10 is a perspective view of a simplified version of the combination fan and light attachable to a hat of the present invention wherein only a single set of air intakes is provided.

Sliding the slide 54 so that the second stop 60 engages the opposing side of the opening area of the clip assembly 40, then the first covering ring 52 covers the first intake openings 22 of the fan cap 20 preventing air A from entering these openings 22 while the second covering ring 52 is positioned such that the second covering ring 52 does not cover the second intake openings 36 of the light cap 32. In this manner, when the turbine fan 18 is operational, the fan 18 draws air A through the second intake openings 36, with the air A passing through air passages 62 within the interior of the housing 12 and blows the drawn air A out through the outlet 24 of the fan cap 20, as best seen in FIGS. 6 and 9. The air passages 62 are formed by the use of appropriate spacers 64 that hold the batteries 38 off of the interior side wall of the housing 12. In this configuration, the drawn air A passes over the heat sink 30 of the light assembly which helps cool the heat sink 30 which helps prolong the life of the bulb 28. By drawing heat off of the heat sink 30, the temperature of the air A is raised. In a simplified version of the combination fan and light attachable to a hat 10, the slide assembly 48 is dispensed with and only one set of intake openings are provided at any desired location for providing working air A for the turbine fan 18 as seen in FIG. 10.

Figure 3:
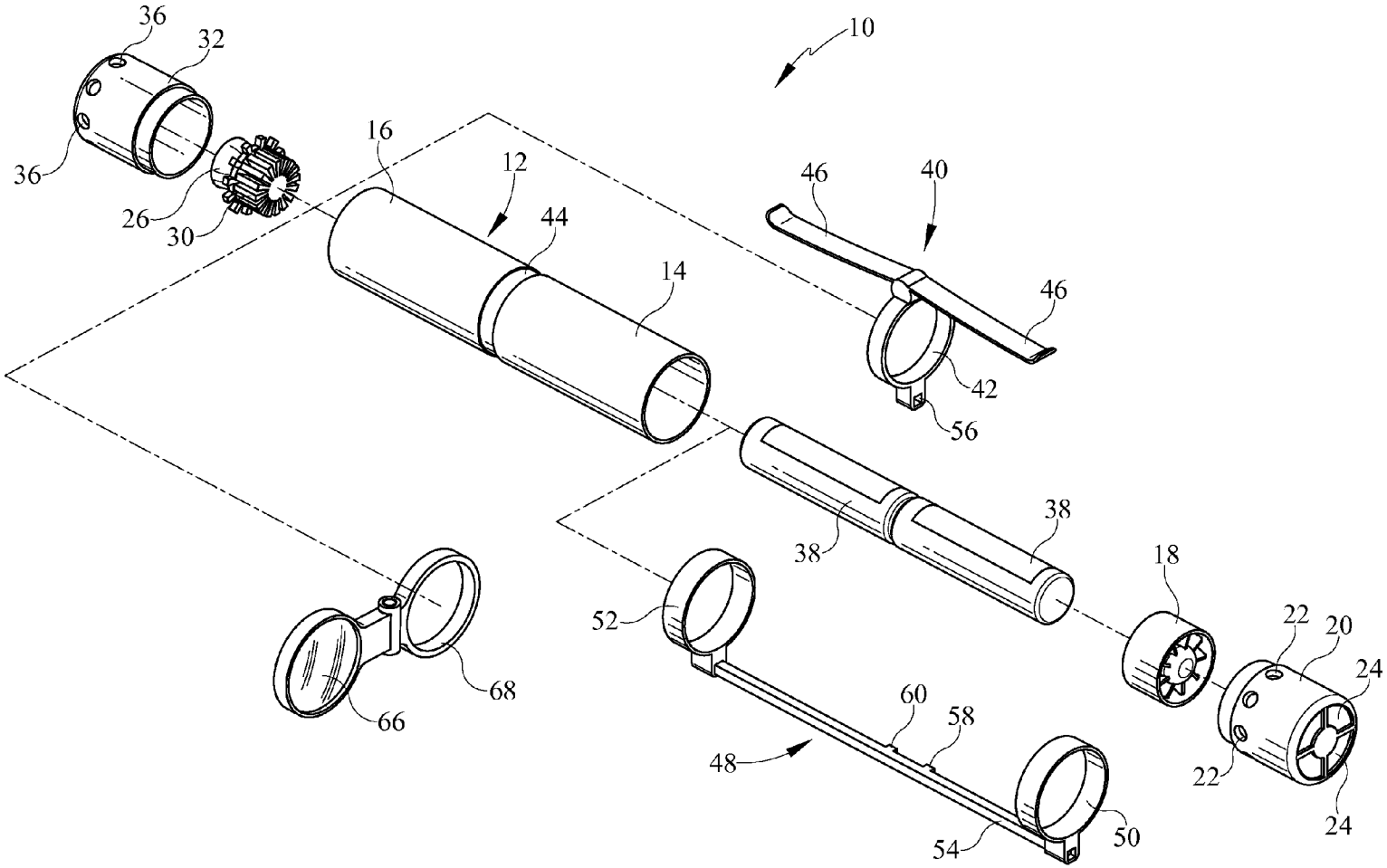
FIG. 3 is an exploded view of the combination fan and light attachable to a hat.
Figure 4:
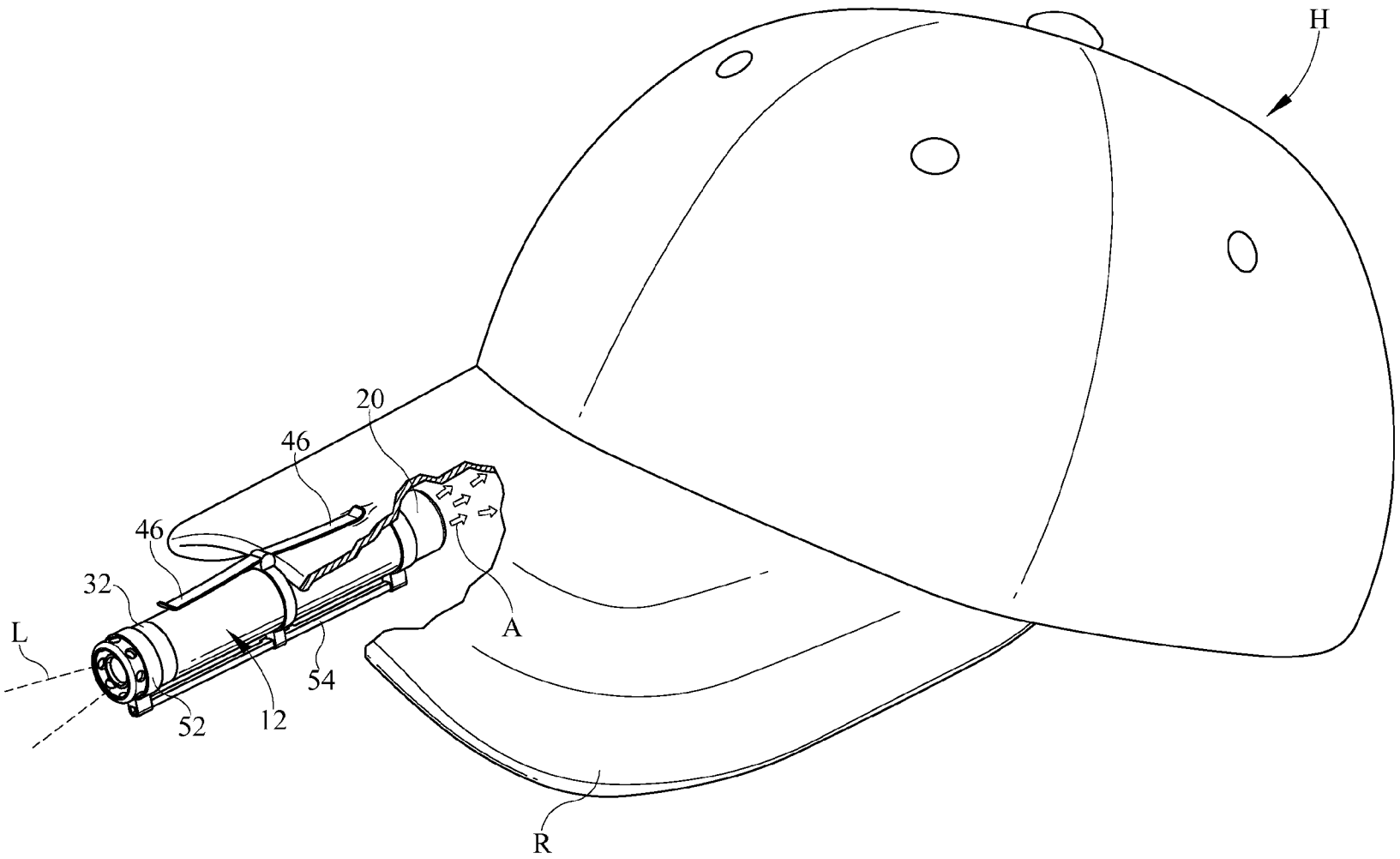
FIG. 4 is an environmental view of the combination fan and light attachable to a hat attached to the brim of a cap.
Figure 5:
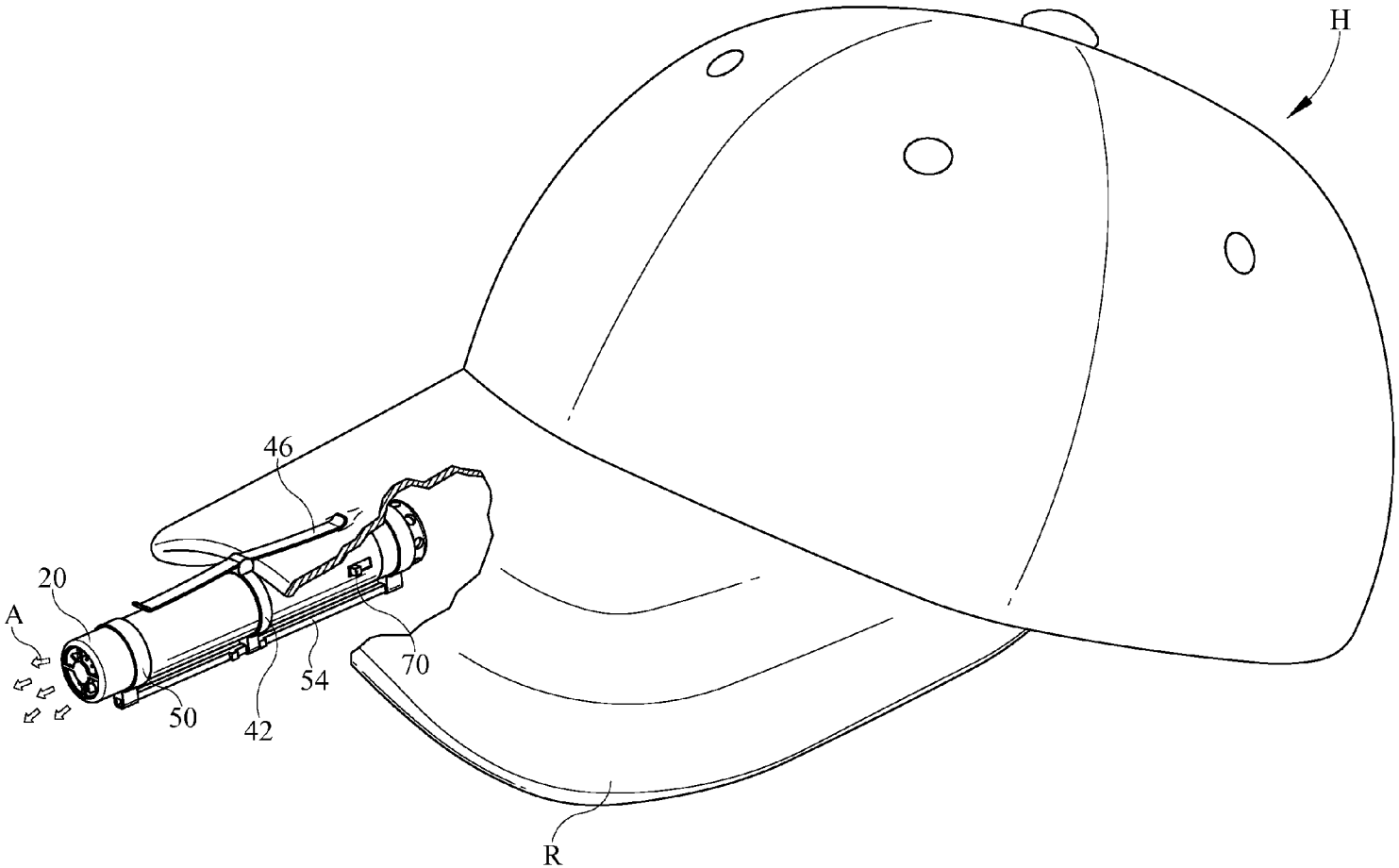
FIG. 5 is an environmental view of the combination fan and light attachable to a hat attached to the brim of a cap in reverse order relative to the attachment of FIG. 4.
Figure 7:
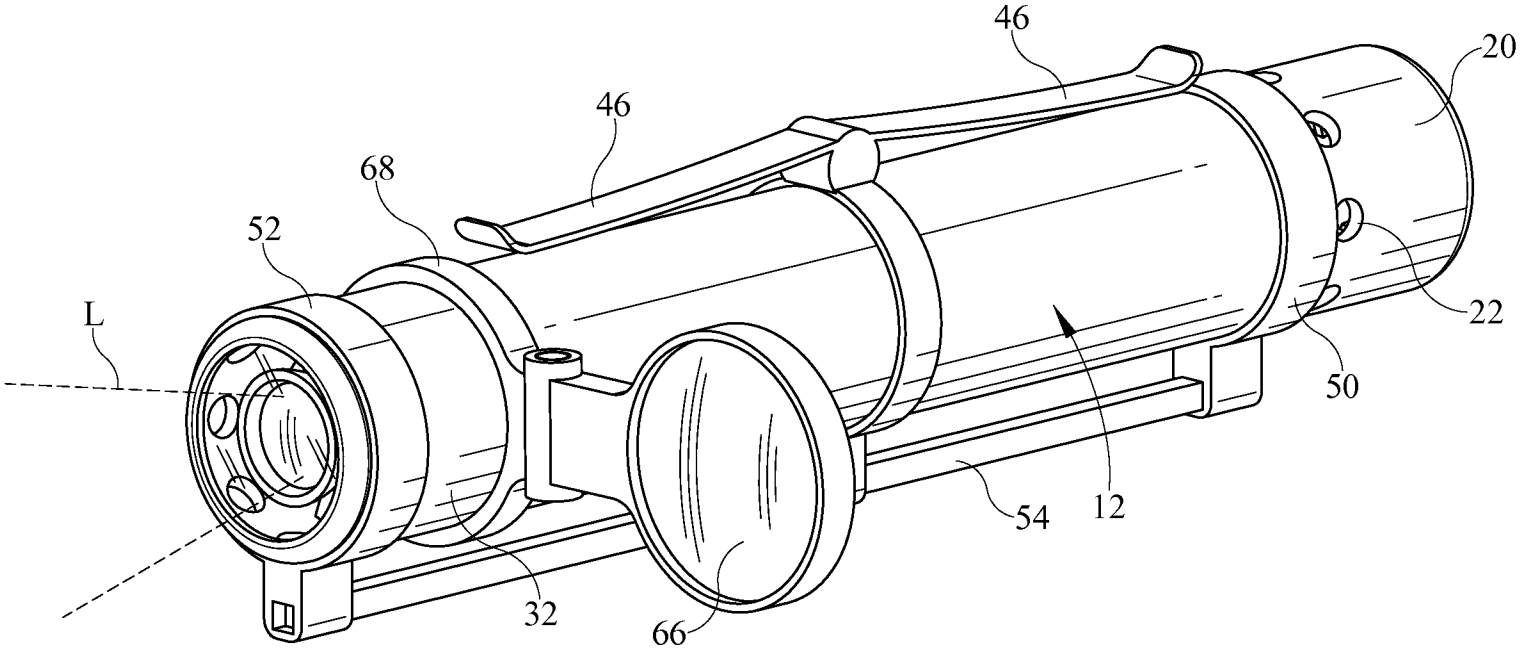
FIG. 7 is a perspective view of the combination fan and light attachable to a hat with an optional magnifying glass hingedly attached to the housing of the device.
Figure 8:
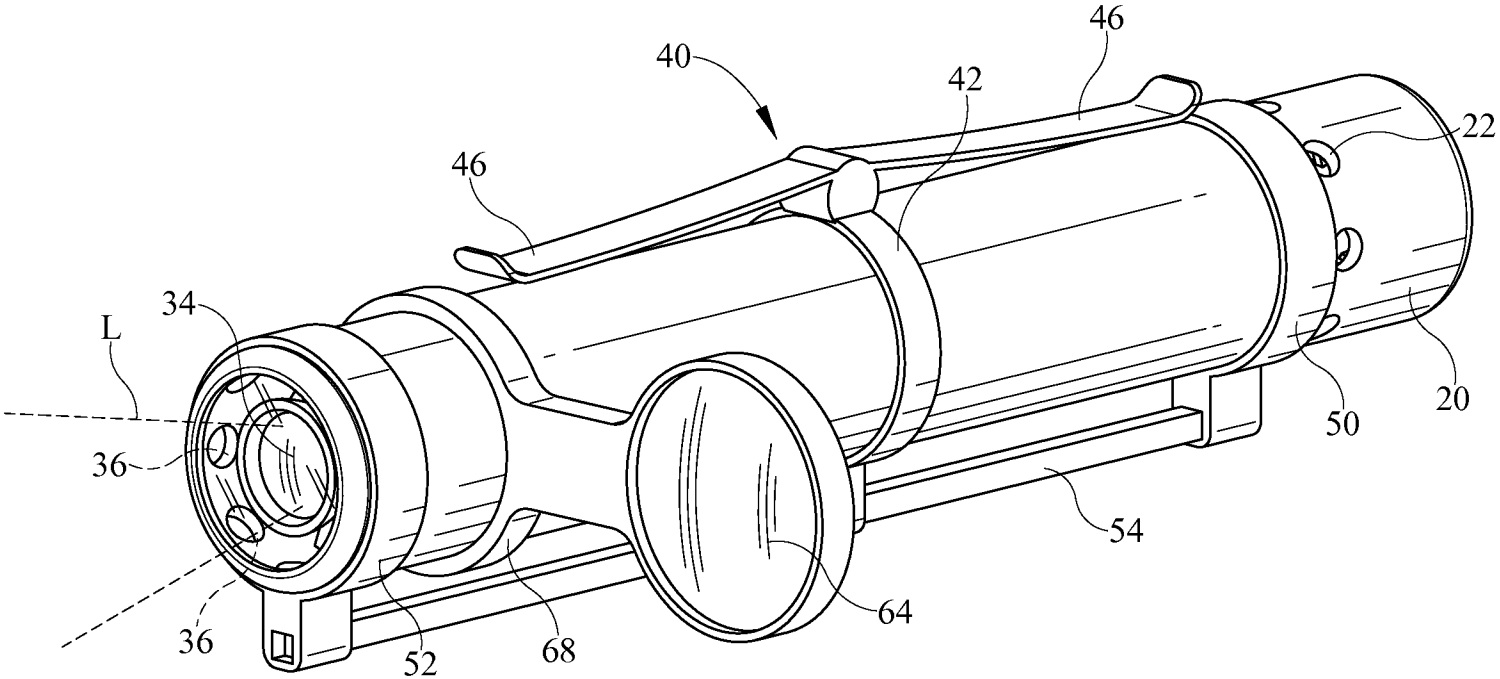
FIG. 8 is a perspective view of the combination fan and light attachable to a hat with an optional magnifying glass fixedly attached to the housing of the device.

A magnifying lens 66 is attached to the housing 12 either via a fixed attachment or, as illustrated, via the attachment ring 68 that encircles the housing 12 and is capable of rotating thereabout. The magnifying lens 66 can be pivotally attached to the ring 68 (or directly to the housing 12) as seen in FIGS. 3 and 7, or can be fixedly attached to the ring 68 (or directly to the housing 12) as seen in FIG. 8. Advantageously, at least one of the clip assembly 40 or the magnifying lens 66 (if provided) is rotatably attached to the housing 12 for ease of use of both left eye dominant and right eye dominant users.

One or more switches 70 are provided for controlling the light 28 and the fan 18 and any other features, such as the below described heating element 74.

Figure 11:
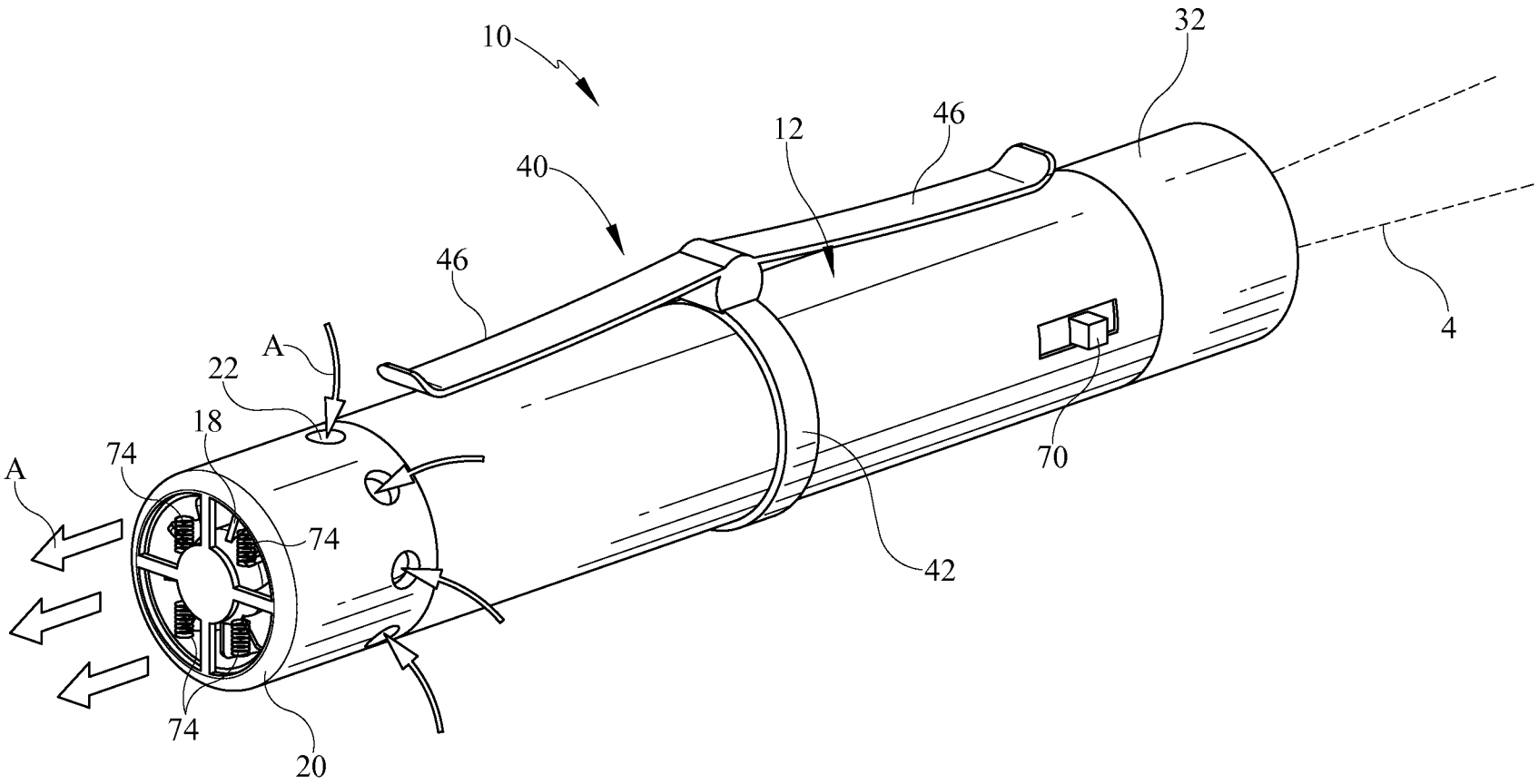
FIG. 11 is a perspective view of the combination fan and light attachable to a hat having heating elements located proximate the air outlets.

As seen in FIG. 11, an alternate method of providing heated air by the turbine fan 18 is to place one or more heating elements 74 proximate the air outlets 24. The heating elements 74 are powered by the batteries 38 in appropriate fashion and controlled by the switch 70. The heating elements provide resistive heat in the usual way so that when the turbine fan 18 blows air A cross the elements 74, the temperature of the air A is increased.

In order to use the combination fan and light attachable to a hat 10 of the present invention, the housing 12 is clipped to a desired target surface such as the brim R of a hat H via one of the clips 46 of the clip assembly 40. The fan 18, the light 28 or both are switched on as desired via the appropriate control switch(es) 70 (can use a four way switch—off, light 28 only, fan 18 only, light 28 and fan 18, or separate switch 70 for light 28 control (including one, off, flash, etc., and switch for fan 18 (including off, on without heat, on with heat, or variable speed, etc.). The slide 54 is slid into the desired position depending on whether the user wants the air A used by the fan 18 to pass over the heat sink 30. If the fan 18 is operational, then air A, either ambient temperature or heated via the heat sink 30, is blown across the person's face for comfort. By using a turbine fan 18, the fear of being hit by a fan blade is diminished. A fan that runs on one or a couple of small (for example double-A) batteries does not produce a large amount of torque, and therefore, getting hit by a rotating blade by such a fan, tends not to cause injury, nevertheless, many people feel intimidated by an open rotating fan blade very close to their face. Therefore, the use of a turbine increases the comfort level of usage. If the light 28 is operational, then a beam of light L shines out from the device 10 with the user either turning his or her head or positioning the device 10 on the brim R as desired. When not desired, the fan 18 or the light 28 is turned off via the control switches 70. If a two way clip is provided, then the device 10 can be positioned in different ways. For example, the housing 12 can be clipped via the clip 46 that faces toward the light assembly to the top of a document (book, magazine, etc.) with the light L shining downwardly onto the page in order to help the user see the document.

If the magnifying lens 66 is provided, then it is used when needed. If the lens 66 is pivotally attached to either the ring 68 or directly to the housing 12, then the lens 66 is pivoted into position when needed, and then pivoted back when not needed. If the user desires to switch the eye with which the lens 66 is aligned, then either the lens 66 is rotated the approximately 180 degrees via the ring 66 or the housing 12 is rotated approximately 180 degrees with respect to the ring 42 of the clip assembly 40.

The combination fan and light attachable to a hat 10 can be provided with other features including providing for various light dispension features such as allowing the light L to issue as a continuous beam or allowing the light L to be pulsed or flashed out of the device 10. Additionally, a filter 72 can be removably attached to the end of the light cap 32 in order to change the color of the light L being issued. In this example, with the attachment of the red filter 72 to the light cap 32 and the light 28 set to a flash mode, the user can turn the hat H around so that a flashing red light L issues from the back of the user's head, which can be used as a safety feature when riding a bicycle.

While the invention has been particularly shown and described with reference to an embodiment thereof, it will be appreciated by those skilled in the art that various changes in form and detail may be made without departing from the spirit and scope of the invention.

I claim:

1. A light and fan assembly comprising:

a tubular housing member having a first end and a second end and a first opening located therebetween, the housing having a first intake opening;

a turbine fan located on a first end of the housing member such that fan is capable of drawing an air stream through the first intake opening and discharging the air stream outwardly from the first end in a first direction;

a light assembly located on a second end of the housing member such that the light assembly discharges a beam of light outwardly from the second end of the housing in a second direction that is opposite in direction to the first direction;

means for heating the air stream prior to the air stream being discharged from the first end; and a clip attached to the housing.

2. The light and fan assembly as in claim 1 wherein the means for heating the air stream comprises a second intake opening located on the housing such that the fan draws the air stream through either the first intake opening or the second intake opening or both such that if the air stream is drawn through the second intake opening the air stream passes over a heat sink of the light assembly, the heat sink located within the housing.

3. The light and fan assembly as in claim 2 further comprising a slide assembly attached to the housing for selectively closing either the first intake opening or the second intake opening but not both simultaneously.

4. The light and fan assembly as in claim 1 wherein the means for heating the air stream comprises a heating element located proximate the first end such that the air stream passes over the heating element prior to being discharged from the first end.

5. The light and fan assembly as in claim 1 wherein the means for heating the air stream comprises either a second intake opening located on the housing such that the fan draws the air stream through either the first intake opening or the second intake opening or both such that if the air stream is drawn through the second intake opening the air stream passes over a heat sink of the light assembly, the heat sink located within the housing or a heating element located proximate the first end such that the air stream passes over the heating element prior to being discharged from the first end.

6. The light and fan assembly as in claim 5 further comprising a slide assembly attached to the housing for selectively closing either the first intake opening or the second intake opening but not both simultaneously.

7. The light and fan assembly as in claim 5 wherein the clip is capable of rotating radially about the housing.

8. The light and fan assembly as in claim 1 wherein the clip is capable of rotating radially about the housing.

9. A light and fan assembly comprising:

a tubular housing member having a first end and a second end and a first opening located therebetween, the housing having a first intake opening;

a turbine fan located on a first end of the housing member such that fan is capable of drawing an air stream through the first intake opening and discharging the air stream outwardly from the first end in a first direction;

a light assembly located on a second end of the housing member such that the light assembly discharges a beam of light outwardly from the second end of the housing in a second direction that is opposite in direction to the first direction;

a filter removably attachable to the first end of the housing such that the light beam issued by the light assembly passes through the filter; and a clip attached to the housing.

10. The light and fan assembly as in claim 9 further comprising means for heating the air stream prior to the air stream being discharged from the first end.

11. The light and fan assembly as in claim 10 wherein the means for heating the air stream comprises a second intake opening located on the housing such that the fan draws the air stream through either the first intake opening or the second intake opening or both such that if the air stream is drawn through the second intake opening the air stream passes over a heat sink of the light assembly, the heat sink located within the housing.

12. The light and fan assembly as in claim 11 further comprising a slide assembly attached to the housing for selectively closing either the first intake opening or the second intake opening but not both simultaneously.

13. The light and fan assembly as in claim 10 wherein the means for heating the air stream comprises a heating element located proximate the first end such that the air stream passes over the heating element prior to being discharged from the first end.

14. The light and fan assembly as in claim 9 wherein the clip is capable of rotating radially about the housing.

15. The light and fan assembly as in claim 9 further comprising a magnifying lens attached to the housing.

16. The light and fan assembly as in claim 15 wherein the magnifying lens is pivotally attached to the housing.

17. The light and fan assembly as in claim 15 wherein the magnifying lens is capable of rotating radially about the housing.

18. The light and fan assembly as in claim 9 further comprising a second intake opening located on the housing such that the fan draws the air stream through either the first intake opening or the second intake opening or both such that if the air stream is drawn through the second intake opening the air stream passes over a heat sink of the light assembly, the heat sink located within the housing.

19. The light and fan assembly as in claim 18 further comprising a slide assembly attached to the housing for selectively closing either the first intake opening or the second intake opening but not both simultaneously.

20. A light and fan assembly comprising:

a tubular housing member having a first end and a second end and a first opening located therebetween, the housing having a first intake opening;

a turbine fan located on a first end of the housing member such that fan is capable of drawing an air stream through the first intake opening and discharging the air stream outwardly from the first end in a first direction;

a light assembly located on a second end of the housing member such that the light assembly discharges a beam of light outwardly from the second end of the housing in a second direction that is opposite in direction to the first direction;

a magnifying lens attached to the housing; and a clip attached to the housing.

21. The light and fan assembly as in claim 20 further comprising means for heating the air stream prior to the air stream being discharged from the first end.

22. The light and fan assembly as in claim 21 wherein the means for heating the air stream comprises a second intake opening located on the housing such that the fan draws the air stream through either the first intake opening or the second intake opening or both such that if the air stream is drawn through the second intake opening the air stream passes over a heat sink of the light assembly, the heat sink located within the housing.

23. The light and fan assembly as in claim 22 further comprising a slide assembly attached to the housing for selectively closing either the first intake opening or the second intake opening but not both simultaneously.

24. The light and fan assembly as in claim 21 wherein the means for heating the air stream comprises a heating element located proximate the first end such that the air stream passes over the heating element prior to being discharged from the first end.

25. The light and fan assembly as in claim 20 wherein the clip is capable of rotating radially about the housing.

26. The light and fan assembly as in claim 20 wherein the magnifying lens is pivotally attached to the housing.

27. The light and fan assembly as in claim 20 wherein the magnifying lens is capable of rotating radially about the housing.

28. The light and fan assembly as in claim 20 further comprising a second intake opening located on the housing such that the fan draws the air stream through either the first intake opening or the second intake opening or both such that if the air stream is drawn through the second intake opening the air stream passes over a heat sink of the light assembly, the heat sink located within the housing.

29. The light and fan assembly as in claim 28 further comprising a slide assembly attached to the housing for selectively closing either the first intake opening or the second intake opening but not both simultaneously.

30. The light and fan assembly as in claim 20 further comprising a heating element located proximate the first end such that the air stream passes over the heating element prior to being discharged from the first end.

* * * * *